United States Patent [19]

Shemonaev et al.

[11] 4,027,438

[45] June 7, 1977

[54] TRANSVERSE FRAME OF INDUSTRIAL BUILDING CARCASS

[76] Inventors: Alexandr Tikhonovich Shemonaev, Ochakovskoe shosse 13, korpus 2, kv. 17; Dmitry Grigorievich Cherny, Nizhnyaya Krasnoselskaya, 45, kv. 116; Semen Naumovich Genis, Krjukovskaya ulitsa, 23, kv. 33; Igor Konstantinovich Vishnitsky, Festivalnaya ulitsa, 19, kv. 71, all of Moscow, U.S.S.R.

[22] Filed: June 11, 1975

[21] Appl. No.: 585,825

[30] Foreign Application Priority Data

June 13, 1974 U.S.S.R. ..... 2037025

[52] U.S. Cl. ..... 52/27; 212/13

[51] Int. Cl.[2] ..... B66C 5/02

[58] Field of Search ..... 212/10, 11, 13, 14, 212/18; 52/167, 39, 27

[56] References Cited

UNITED STATES PATENTS

| | | | |
|---|---|---|---|
| 869,929 | 11/1907 | McClellon | 212/11 |
| 1,952,238 | 3/1934 | Dice | 212/13 |
| 2,208,872 | 7/1940 | Ropp | 52/167 |
| 2,690,074 | 9/1954 | Jones | 52/167 |
| 3,051,321 | 8/1962 | Ramsden | 212/14 |
| 3,389,809 | 6/1968 | Wilson | 212/10 |
| 3,638,377 | 5/1972 | Caspe | 52/167 |

FOREIGN PATENTS OR APPLICATIONS

| | | | |
|---|---|---|---|
| 778,240 | 2/1968 | Canada | 212/10 |
| 1,215,536 | 4/1960 | France | 52/167 |
| 1,016,428 | 9/1957 | Germany | 212/10 |
| 420,480 | 4/1947 | Italy | 52/167 |
| 496,592 | 12/1938 | United Kingdom | 52/167 |

*Primary Examiner*—Price C. Faw, Jr.
*Assistant Examiner*—Henry Raduazo

[57] ABSTRACT

The invention relates to building structures and, more particularly, to the transverse frame of an industrial building carcass wherein columns carry a crossbar and a supporting member of the building roof arranged above said crossbar. The column portions located above the crossbar are rigidly connected with the latter, forming a U-shaped frame which rests through hinges on the column portions located below the crossbar and the roof supporting member is thrust tightly between the free ends of said U-shaped frame. This layout of the transverse frame reduces the height of the crossbar section to the dimensions which allow it to be carried by rail without separating it longitudinally thus reducing the amount of erection work during the construction of industrial building carcasses and diminishing their height. Such a transverse frame is lighter than the known frames of the same type.

3 Claims, 6 Drawing Figures

TRANSVERSE FRAME OF INDUSTRIAL BUILDING CARCASS

BACKGROUND OF THE INVENTION

The present invention relates to building structures and more particularly it relates to the transverse frames of industrial building carcasses.

The present invention can be utilized to the best advantage in the carcasses of boiler rooms in thermal power stations with suspended boilers.

Known in the previous art are transverse frames of the carcasses of industrial buildings, particularly thermal power stations (see, for example "The Paradise Steam Plant. Technical Report", No. 37, Tennessee, USA, 1964) comprising columns mounting a crossbar which carries the weight of the industrial equipment, and a supporting member of the building roof located above said crossbar.

The lower portions of the columns in the transverse frame of this type are usually made more solid to support the crossbar which is made in the form of a double-supported beam with a double-T or box-shaped cross section whereas the supporting member of the building roof has the form of a truss resting on the upper ends of the columns through hinges.

In these transverse frames there is a space between the crossbar and the roof supporting member to accommodate the equipment of the corresponding industrial enterprise and to allow the passage of a bridge crane which is intended for erection, servicing and repairs of the equipment either mounted on the crossbar or suspended from it as, for example, suspended boilers in thermal power stations.

The main disadvantage of such transverse frames of industrial building carcasses lies in that the considerable weight of the equipment (boilers) and large spans of these frames require a considerably high cross section of the crossbars (up to 7.5 m) which exceeds almost twice the standard railway clearance gauge.

To ensure transportation by rail of these crossbars from the Manufacturing Plant to the building sites, such crossbars are made of two parts in height with a longitudinal joint in their wall.

This joint is assembled at the building sites before erection of the transverse frame.

The work involved in assembling the joint is sufficiently difficult and calls for the provision at the building site of additional industrial equipment and skilled personnel.

The design of the known transverse frames predetermines the considerable weight of the crossbars so that in a number of cases, they have to be placed on the columns by individual parts which are then joined longitudinally. This increases still further the amount of labour required for erecting the known transverse frames.

Finally, due to large forces arising in the crossbar flanges, it becomes necessary to make the flanges from a number of plates in height, the joining of said plates also being a labour-consuming job.

OBJECTS AND SUMMARY OF THE INVENTION

The main object of the invention to provide a transverse frame of an industrial building carcass wherein the height of the cross section of its crossbar could be reduced to the standard railway clearance gauge to allow the crossbar to be transported as a whole, without separating it longitudinally in height so that it would not have to be later assembled on the building site thus reducing the labour requirement for erecting the transverse frame of the carcass as a whole.

This object is accomplished by providing a transverse frame of an industrial building carcass wherein two columns carry a crossbar and a supporting member of the building roof arranged above said crossbar wherein, according to the invention, the portions of the columns above the crossbar are rigidly connected with the latter, forming a U-shaped frame which rests through hinges on the column portions below crossbar and the supporting member of the roof is thrust tight between the free ends of said U-shaped frame.

Because of the redistribution of the summary bending moment caused by the weight of the equipment located between the element of the frame (crossbar and column portions rigidly connected to it) the crossbar of such a U-shaped frame is subjected to a considerably smaller bending moment than the crossbars of the known transverse frames.

This allows the height of the crossbar cross section to be reduced to the standard railway clearance gauge and makes it possible to carry the crossbars in one piece without subsequent necessity of assembling its parts longitudinally at the building site.

Such an optimum distribution of the bending moment between the elements of the U-shaped frame ensures a considerable reduction in their weight.

The reduction in the height of the crossbar as compared with the known crossbars yields a considerable reduction in the total height of industrial buildings.

All this taken together decreases the amount of labour required in making and erecting the transverse frames and cuts down the building costs of the industrial building carcass as a whole.

According to one of the possible embodiments of the invention the supporting member of the roof takes the form of a beam whose ends are connected with the free ends of the U-shaped frame by horizontal hinges whose axes are perpendicular to the vertical plane passing through the longitudinal axis of the roof supporting member and are offset from this axis by a distance which is required for counterbalancing the bending moment arising in the roof supporting member due to the weight of the roof.

Because of this solution the supporting member of the roof is bent in a reverse direction which counterbalances the deflection caused by the weight of the roof; this makes for a considerable reduction in the weight of the roof supporting member.

According to another embodiment of the invention the roof supporting member is rigidly connected with the free ends of the U-shaped frame.

Such a solution further reduces the bending moment in the span of the transverse frame crossbar.

BRIEF DESCRIPTION OF THE DRAWINGS

Given below is a detailed description of two probable embodiments of the invention with reference to the accompanying drawings (in which.

DETAILED DESCRIPTION OF PREFERRED EMBODIMENTS

One of the embodiments of the invention will be discussed by describing the transverse frame of the carcass of a boiler room in a thermal power station with suspended boilers.

Figure 1:
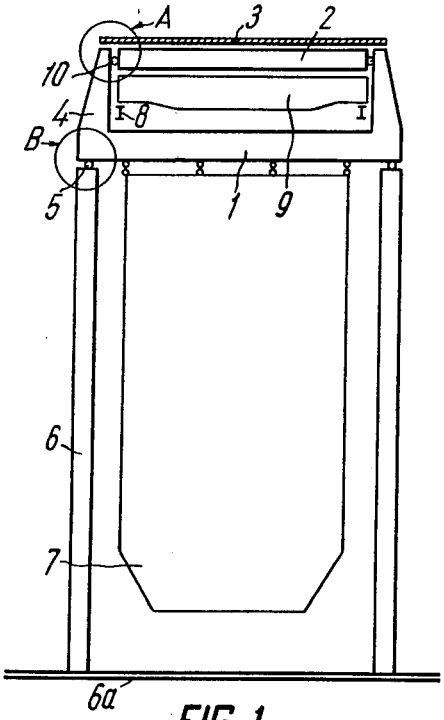
FIG. 1 is a schematic representation of a first version of the transverse frame of the industrial building carcass according to the invention.
Figure 2:
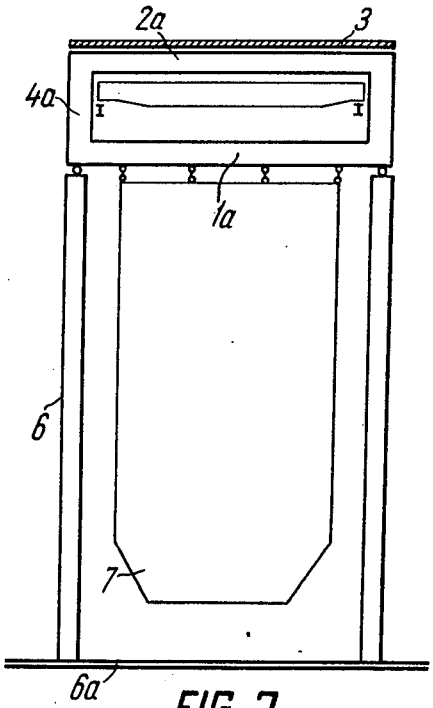
FIG. 2 — same, a second embodiment.

The transverse frame of the building carcass comprises two columns which carry a crossbar 1 (FIGS. 1 and 2) and a supporting member 2 of the building roof 3 located above said crossbar.

According to the invention, the column portions 4 located above the crossbar 1 are rigidly connected with the latter and form a U-shaped frame which rests on the column portions 6 below the crossbar 1 via horizontal hinges 5.

The hinges 5 can be of any type known in the building industry. The column portions supporting the U-shape frame are made in the form of pillars whose lower ends are embedded in foundations 6*a*.

According to the invention, the supporting member 2 of the roof 3 is thrust tight between the free ends of the column portions 4 located above the crossbar 1, said portions 4 being in fact free ends of the U-shaped frame.

The boiler 7 is suspended from the crossbar 1 while the space between the crossbar 1 and the supporting member 2 of the building roof 3 accommodates guides 8 for the installation of a bridge crane 9 to be used for erection and repairs of the boiler 7.

In the first embodiment of the transverse frame (FIG. 1) according to the invention, the supporting member 2 of the roof 3 has the form of a beam whose ends are connected with the free ends of the U-shaped frame (in fact, with the ends of the column portions 4 located above the crossbar 1) by means of hinges 10.

According to the invention, the axes of said hinges 10 are perpendicular to the vertical plane passing through the longitudinal axis 11 (FIG. 3) of the supporting member 2 of the roof 3 and are displaced downward from said axis 11 by a distance "E" which is selected to be sufficient for counterbalancing the bending moment arising in the supporting member 2 of the roof 3 owing to the weight of the latter.

Such a displacement from the axis 11 of the hinges 10 produces a reverse deflection in the supporting member 2 of the roof 3 which counterbalances the dead-load deflection caused by the weight of the roof so that the beam of the supporting member 2 can be made considerably lighter.

In the other embodiment of the transverse frame (FIG. 2) the supporting member 2*a* of the roof 3 is rigidly connected with the free ends of the column portions 4*a* located above the crossbar 1*a* and forms a frame with a rigid closed contour.

The transverse frame of the boiler room carcass is carried to the building site in separate components, viz., column portions 4 and 6 located above and below the crossbar 1, respectively, the crossbar 1 and the supporting member 2 of the roof 3.

Figure 3:
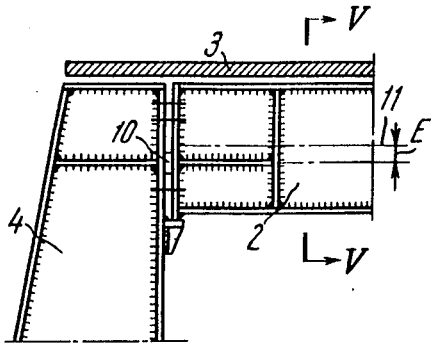
FIG. 3 — fragment "A", in FIG. 1, enlarged.
Figure 5:
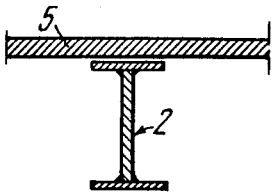
FIG. 5 — is a section taken along line V—V in FIG. 3.
Figure 4:
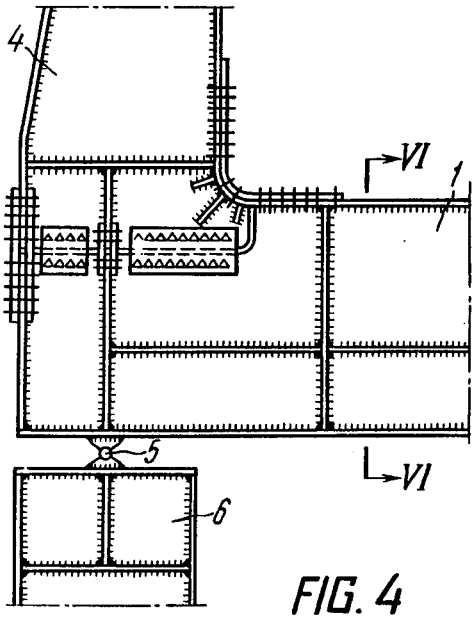
FIG. 4 — fragment "B" in FIG. 1, enlarged.
Figure 6:
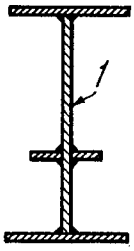
FIG. 6 — is a section taken along line VI—VI in FIG. 4.

At the building site the U-shaped frame is preliminarily assembled for which purpose the lower ends of the column portions 4 located above the crossbar 1 are welded and bolted to the crossbar 1 as shown in FIGS. 4 and 6 while the supporting member 2 is thrust tightly between the upper ends of these column portions 4 (as it is shown in FIGS. 3 and 5). In the first embodiment (FIG. 1) the ends of the supporting member 2 of the roof 3 are connected with the upper ends of the column portions 4 located above the crossbar 1 by means of hinges 10 as it is illustrated in FIG. 3 while in the second embodiment (FIG. 2), they are connected rigidly, similarly to the connection of the crossbar 1 with the column portions 4 located above the crossbar, as shown in FIGS. 4 and 6.

The crossbars 1 and 1*a* and the supporting members 2 and 2*a* of the roof 3 are made in both embodiments of the transverse frame in the form of beams of a double-T cross section as illustrated in FIGS. 6 and 5. The column portions 4 and 6 may have the same shape though the column portions 6 located below the crossbar 1 supporting the U-shaped frame, are made more solid, for example, of a box-shaped section.

Erection of the transverse frame is started by placing the lower portions 6 of the columns vertically to the required position and their lower ends are secured in the foundations. Then the U-shaped frame complete with the supporting member 2 of the roof 3 is installed on hinges 5 on the upper ends of the column lower portions 6.

After installation of all of the transverse frames of the boiler room carcass, the supporting member 2 of the roof 3 is covered by the roofing, the bridge crane 9 is installed in the space between the crossbar 1 and the supporting member 2 of the roof 3 after which the boiler 7 is attached to the crossbar 1 with the aid of the crane 9.

What is claimed is:

1. A transverse frame of an industrial building carcass comprising: lower columns, upper columns, a crossbar mounted on said lower columns; a supporting member of the building roof mounted on said upper columns above said crossbar wherein the upper columns located above the crossbar are rigidly connected with the said crossbar, forming a U-shaped frame which is fixed through hinges to the lower columns located below the crossbar and the supporting member of the roof is thrust tightly between the free ends of said U-shaped frame.

2. A transverse frame according to claim 1 wherein the supporting member of the roof is made in the form of a beam whose ends are connected with the free ends of the U-shaped frame with the aid of hinges whose axes are perpendicular to the vertical plane passing through the longitudinal axis of the roof supporting member and are displaced from said axis by a distance which is selected to be sufficient to balance the bending moment arising in the supporting member of the roof due to the weight of the latter.

3. A transverse frame according to claim 1 wherein the roof supporting member is rigidly connected with the free ends of the U-shaped frame.

* * * * *